US007040840B2

(12) United States Patent
Zook

(10) Patent No.: US 7,040,840 B2
(45) Date of Patent: May 9, 2006

(54) SEWAGE EFFLUENT DISTRIBUTION MEANS

(76) Inventor: Neal Zook, 5598 Nehrt Rd., Bloomington, IN (US) 47408

( * ) Notice: Subject to any disclaimer, the term of this patent is extended or adjusted under 35 U.S.C. 154(b) by 0 days.

(21) Appl. No.: 10/988,879

(22) Filed: Nov. 15, 2004

(65) Prior Publication Data

US 2005/0180819 A1 Aug. 18, 2005

(51) Int. Cl.
*E02B 11/00* (2006.01)

(52) U.S. Cl. ..... 405/51; 405/36; 137/395; 210/532.2; 210/170

(58) Field of Classification Search ..... 405/36, 405/40, 51; 137/395, 397, 399, 433; 210/532.1, 210/532.2, 170, 747
See application file for complete search history.

(56) References Cited

U.S. PATENT DOCUMENTS

| | | | | |
|---|---|---|---|---|
| 2,793,908 A | | 5/1957 | Carver, Jr. | 299/27 |
| 3,451,554 A | | 6/1969 | Wade | 210/278 |
| 3,956,137 A | | 5/1976 | Dempsey | 210/532 |
| 4,092,995 A | | 6/1978 | Stubenruss | 137/119 |
| 4,116,216 A | | 9/1978 | Rosenberg | 137/624.13 |
| 4,313,455 A | | 2/1982 | Pitman | 137/119 |
| 4,414,109 A | | 11/1983 | Aurthur | 210/278 |
| 4,492,247 A | | 1/1985 | Lockwood | 137/119 |
| 4,614,584 A | * | 9/1986 | Di Duca | 210/422 |
| 4,632,361 A | | 12/1986 | Callison | 251/230 |
| 4,790,512 A | | 12/1988 | Lindsay | 251/129.2 |
| 5,022,426 A | | 6/1991 | Fischer | 137/119 |
| 5,118,418 A | | 6/1992 | Roussel | 210/278 |
| 5,597,264 A | * | 1/1997 | Laak | 405/36 |
| 5,647,986 A | | 7/1997 | Nawathe et al. | 210/608 |
| 5,988,943 A | * | 11/1999 | McCord | 405/36 |
| 6,050,286 A | | 4/2000 | Kruer et al. | 137/119.03 |
| 6,059,967 A | | 5/2000 | Field | 210/247 |
| 6,277,280 B1 | | 8/2001 | Houck | 210/616 |
| 6,345,645 B1 | | 2/2002 | Kenna et al. | 137/625.11 |
| 6,622,933 B1 | | 9/2003 | Young et al. | 239/66 |
| 6,749,743 B1 | | 6/2004 | Rohrer et al. | 210/97 |
| 6,886,588 B1 | * | 5/2005 | Malenfant et al. | 137/399 |

FOREIGN PATENT DOCUMENTS

JP 11014513 * 1/1999

* cited by examiner

*Primary Examiner*—Jong-Suk (James) Lee
(74) *Attorney, Agent, or Firm*—Brinks Hofer Gilson & Lione

(57) ABSTRACT

Effluent-operated valves provide, in a septic system, distribution of effluent uniformly to a plurality of portions or fingers of a drain field. The installation of such valves in a tank that collects septic system effluent to be distributed to a plurality of fingers permits the uniform distribution of effluent from within the tank to a plurality of portions of a drain field, either simultaneously, or to one portion at a time in sequence.

30 Claims, 3 Drawing Sheets

SEWAGE EFFLUENT DISTRIBUTION MEANS

FIELD OF THE INVENTION

This invention relates to septic systems for the treatment of sewage, and more particularly relates to systems for the distribution of the effluent of a septic system to a drain field, including a plurality of fingers.

BACKGROUND OF THE INVENTION

Septic systems are extensively used to treat sewage from individual residences and businesses in areas not served by sewers. In the treatment of sewage by such septic systems, solid and liquid waste from the residence or business is collected in a septic tank in which, because of their different densities, the solid and liquid components of the sewage separate. The solid material is decomposed within the tank by the action of anaerobic bacteria, resulting in a liquid effluent. The liquid effluent is then conveyed out of the tank and distributed through an area of subterranean soil, which is frequently referred to as a drain field, and the liquid effluent then percolates through the soil and becomes purified before again joining the underground water table.

U.S. Pat. Nos. 6,749,743; 6,277,280; 5,647,986; and 3,956,137 relate to septic systems and various aspects of their operation.

In practice, sewage drain fields are generally divided into a number of portions, (frequently referred to as fingers as in this document) and the effluent is distributed to the portions, or fingers, and over a wide area to avoid oversaturation of a portion of the drain field. In systems where the drain field is divided into a plurality of fingers, it is common to include in the system a distribution tank to receive the effluent from the septic tank and to distribute it to the plurality of fingers forming the drain field.

In the past, such effluent distributors have comprised a tank having an inlet connected with the effluent outflow of the septic tank and with a plurality of outlets distributed around the periphery of the bottom of the tank, which are connected by underground tubing or piping to the various fingers of the drain field. It is not uncommon, however, for the ground under such a distribution tank to settle, allowing the distribution tank to be tilted so that only one or a few of the fingers of the drain field receive all or a substantially greater part of the effluent outflow of the septic system. Under such conditions, the soil affected by the portion of the drain field receiving effluent can become saturated, requiring service of the septic system and possibly modification of the drain field. Because of the required excavation, re-installation of the distribution tank and the possible installation of new underground pipes, the servicing and modification of the sewage system can be expensive. The life of a septic system drain field can be substantially extended if the effluent from the septic system is uniformly distributed in the drain field.

Thus, a sewage effluent distribution system which uniformly distributes sewage to all portions or fingers of the drain field can avoid expensive servicing and extend the life of the drain field. It is also desirable that such a sewage distribution system not require the provision of power and power-actuated components.

BRIEF SUMMARY OF THE INVENTION

The invention provides, in a septic system, means for distributing effluent uniformly to a plurality of portions or fingers of a drain field. In the invention, effluent-operated valve means distribute the effluent of a septic system uniformly to a plurality of the portions of a drain field. Such effluent-operated valve means can have an inlet that can open into an effluent distribution tank and a plurality of effluent outlets, each of the effluent outlets being connectible to a different one of a plurality of fingers of a drain field. The inlet of such valve means remains closed until effluent accumulates and operates the valve means opening the valve inlet to one or more of the plurality of valve outlets and permitting accumulated effluent to flow uniformly from a tank into connected portions of a drain field. The effluent-operated valve means can be operated by accumulated effluent to connect the valve inlet to all of the plurality of outlets, or can be operated by accumulated effluent to sequentially connect the valve inlet to one of the plurality of the outlets, one after another, permitting effluent to flow sequentially to different fingers of a drain field, one finger at a time.

A preferred effluent distribution means of the invention includes a first effluent-operated valve and a second effluent-operated valve that can be placed in a distribution tank for receiving effluent to be distributed to a plurality of fingers of a drain field. With the preferred distribution means of the invention, effluent is uniformly distributed to the drain field by directing the effluent to the plurality of fingers of a drain field, one finger at a time in sequence. The first effluent-operated valve has a valve body with an inlet opening and an outlet opening, and a valve closure connected with a buoyant element, which can be operated by accumulated effluent in a distribution tank to allow effluent to flow through said inlet and outlet openings of the valve body until the effluent in the distribution tank has been substantially distributed to the drain field. The second effluent-operated valve has an inlet and a plurality of outlet openings, with the inlet opening of the second effluent-operated valve being connected with the outlet opening of the first effluent-operated valve. Each of the plurality of outlet openings of the second effluent-operated valve can be connected with a different one of a plurality of fingers of a drain field. The second effluent-operated valve has a valving member with a single opening, which is driven by connected buoyant material. The second effluent-operated valving member, because of its connection to the buoyant material, can be operated by effluent in a distribution tank to align its single opening with one of the plurality of outlet openings of the second effluent-operated valve, and direct effluent from a distribution tank to the one finger that is connected to the one outlet opening. In one preferred second effluent-operated valve, each time a distribution tank fills with effluent, the rising level of effluent in the distribution tank raises and rotates the valving member, positioning the single opening of the valving member in alignment with a different outlet opening so that when the accumulated effluent in the distribution tank operates the first effluent-operated valve and opens its inlet opening, the accumulation of effluent in the distribution tank is emptied through a different outlet opening of the second effluent-operated valve to a different portion of the drain field. In operation of a preferred effluent distribution means of the invention, a distribution tank can be substantially emptied each time effluent accumulates therein to a different finger of the drain field in sequence by operation of the first and second effluent-operated valves.

The invention can thus provide a septic system in which effluent is uniformly distributed among the fingers of the drain field, thus avoiding or deferring expensive servicing of the septic system, and provides means for uniformly distributing effluent into a drain field that can easily be added to existing septic systems to avoid or defer such expensive servicing.

Further features and advantages of the invention will be apparent from the following description and the accompanying drawings.

DETAILED DESCRIPTION OF THE PREFERRED EMBODIMENTS OF THE INVENTION

Figure 1:
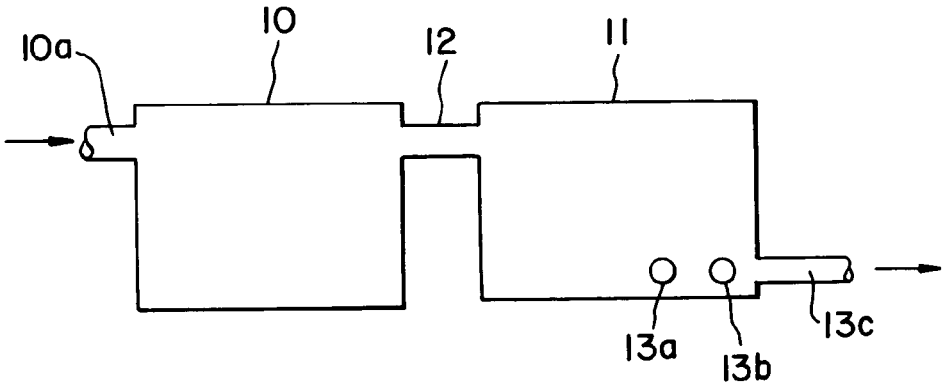
FIG. 1 is a simple diagram of a septic system.

FIG. 1 is a diagram of a typical septic system. Such a system includes a septic tank 10 into which raw sewage is directed through an inlet 10*a* for treatment. In the septic collection tank 10, solid material and liquid material become segregated by virtue of their different densities, and the solid material is decomposed by the action of anaerobic bacteria. The resulting liquid sewage effluent flows from tank 10 to a distribution tank 11 through an interconnecting piping 12. In prior art systems, the distribution tank 10 includes a plurality of outlets 13*a*, 13*b*, 13*c* . . . 13*x*, each of which is connected to a different portion or finger of the drain field. In such systems, liquid effluent flows from the distribution tank 11 into the plurality of outlets 13*a*, 13*b*, 13*c* . . . 13*x* under the influence of gravity. If, however, the position of distributor box 11 shifts under the earth so that one or a few of the plurality of outlets, for example, outlet 13*c* shown in FIG. 1, is lower than others of the. plurality of outlets, a disproportionate flow of effluent to one portion of the drain field will occur, increasing the possibility of over-saturation of that portion of the drain field. If the distribution box 11 becomes sufficiently tilted, with a slow influx of effluent to the distribution tank, some of the plurality of outlets may receive no effluent at all. The invention overcomes this problem, among others, by effluent-operated valve means as described below, which may be installed in the distributor tank 11 to distribute effluent uniformly to the portions or fingers of the drain field.

Figure 2C:
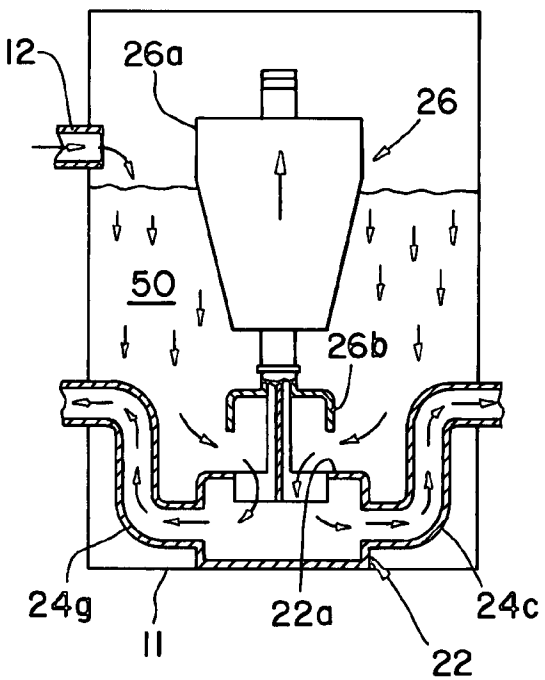
FIG. 2C is a diagrammatic view of the effluent-operated valve of FIGS. 2A and 2B, as installed in a distribution tank and shown in FIG. 2B, shown in part in a cross-sectional view taken at a plane through the center of the valve to show the valve in its open position.
Figure 2B:
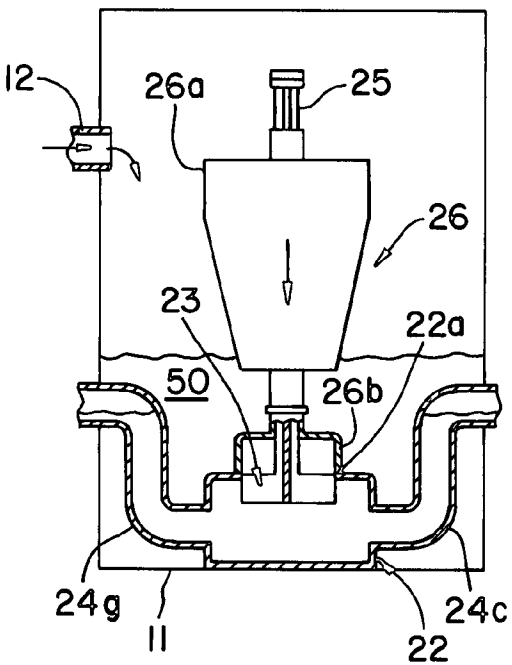
FIG. 2B is a diagrammatic view of the effluent-operated valve of FIG. 2A as installed in a distribution tank, shown in part in a cross-sectional view taken at a plane through the center of valve to show the valve in its closed position.
Figure 2A:
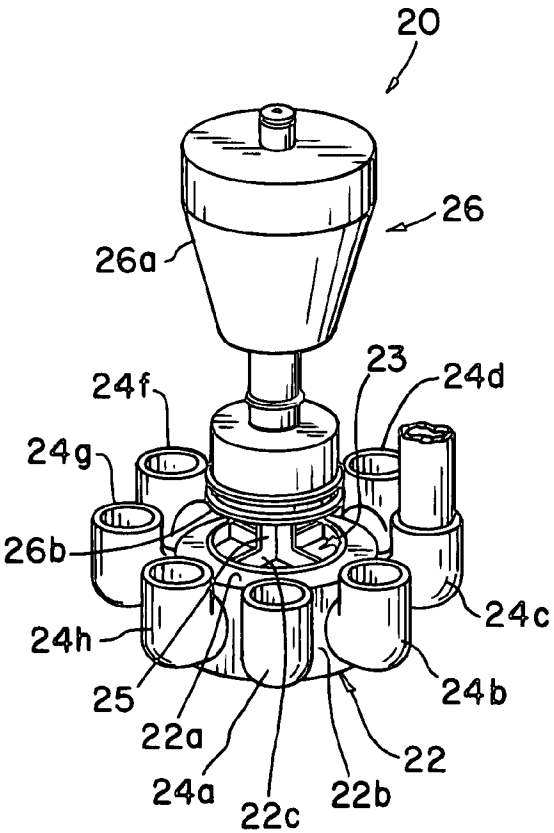
FIG. 2A is a perspective view of a preferred effluent-operated valve of the invention.

FIG. 2A is a diagrammatic perspective view of one preferred effluent-operated valve means 20 of the invention, which may be located adjacent the bottom of a distribution tank 11, as shown in FIGS. 2B and 2G. As illustrated by FIG. 2A, the effluent-operated valve means 20 comprises an effluent distributor 22, which is preferably cylindrical, with a closed bottom (FIGS. 2B and 2C) and an inlet 23 formeded at its upper end by an annular flange 22*a*, and with a plurality of cutlets 24*a*, 24*b*, 24*c* . . . 24*x*, formed in and about its sidewall 22*b*. The effluent-operated valve closure 26, including a buoyant member 26*a* actuated by accumulated effluent, and further including an annular sealing portion portion 26*b* at its bottom to engage and seal the annular flange 22*a*, closing inlet 23 in the absence of accumulated effluent. As further shown by FIG. 2A, the effluent distributor 22 carries an upwardly extending guide rod 25 by an open structure 22*c* at its upper end. The guide rod can have any cross-sectional shape. The guide rod 25 extends through an elongated axial passageway formed at the central axis of and extending through the effluent-operated valve closure 26. The buoyant member 26*a* may be made of any material having a density substantially less than the effluent which has about the density of water. For example, the buoyant member 26*a* may be conveniently formed from polyethylene foam. Although the buoyant member 26*a* is shown in the form of an inverted cone, any shape may do, provided it defines a sufficient volume to displace a sufficient volume of water to develop a lifting force sufficient to overcome the weight of the valve closure portion 26*b* and the force developed by the pressure of the effluent acting downwardly on the surface of the valve closure portion 26*b*.

FIGS. 2B and 2C illustrate operation of such a valve when located in an effluent distribution tank 11. As illustrated by FIG. 2B, when the level of the effluent 50 accumulated in the distribution tank 11 is low (for example, after the effluent has been distributed to the drain field), the lack of effluent in the distribution tank allows the weight of the valve closure 26 to urge the sealing portion 26*b* of the valve closure 26 against the annular flange 22*a*, closing the inlet 23 of the effluent-operated valve 20 so no effluent escapes the distribution tank through outlets 24*a*, 24*b*, 24*c* . . . 24*x*. When a sufficient volume of effluent 50 has accumulated in the distribution tank 11, the buoyant member 26*a* develops an upward force, as shown by the arrow in FIG. 2C, which will overcome the weight of the valve closure 26 and the downward force developed by the hydraulic pressure on the upper surfaces of closure portion 26*b* and lift the valve closure portion 26*b* from the annular flange 22*a*, allowing the effluent 50 within the distribution tank 20 to drain through the inlet opening 23 of the valve 20 and outwardly through the output openings 24*a*, 24*b*, 24*c* . . . 24*x* to the fingers of the drain field that are connected thereto, as shown by the arrows in FIG. 2C.

Effluent-operated valve 20 thus comprises a chamber-forming distributor element 22 that includes an effluent inlet 23 at its top, communicating with a plurality of effluent outlets 24*a*, 24*b*, 24*c* . . . 24*x* that are connected to the different fingers of the drain field. An upwardly extending rod 25 serves as a guide for a buoyancy-driven valve element 26 that covers and seals the inlet 23 of the distributor element 22. Accumulated effluent creates a lifting force on the buoyancy member 26*a* and overcomes the weight of the effluent-driven valve portion 26*b* and the hydraulic force acting downwardly on the valve portion 26*b* and lifts the valve element 26*b* from its closure of inlet 23 which results in a surge of effluent that flows into the effluent inlet 23 and from the plurality of outlets 24*a*, 24*b*, 24*c* . . . 24*x*, into the fingers of the drain field, thus overcoming problems that may be created by a distribution box 11 that settles unevenly and results in a failure of sewage flow into all the fingers of the sewage system.

In one example of a preferred effluent-operated valve 20, the distribution element 22 can have a cylindrical side wall with a diameter of from about 5 to about 8 inches and a height of about 2 inches, with an annular flange 22*a* at its top having a width of about one half inch. Such a cylindrical distribution element 22 can easily accommodate up to eight outlet openings of about one inch in diameter. In such an effluent-operated valve, the valve closure portion 26*b* can comprise a concave elastomeric element having a lip sized to engage the central annular portion of the annular flange 22*a*, and the buoyant member 26*a* can comprise a polyethylene foam member in the form of an inverted cone having a maximum outer diameter of from about 7 to about 9 inches tapering to a minimum diameter as small as about 1 inch. The distributor member 22 can be molded from a thermoplastic material such as polyvinylchloride, polyethylene, polypropylene, nylon or fiber-reinforced nylon and can be formed in two or more pieces. The guide rod 25 may be nylon rod having a sufficient length to allow the valve closure portion 26*b* to travel a substantial portion of an inch or more above the annular lip 22*a*.

Such an effluent-operated valve 20 may be placed in a distribution tank which has become sufficiently tilted that effluent actually flows from only a portion of the distribution tank outlets to only a portion of the drain field and can, through its action, provide effluent uniformly to all of the portions or fingers of the drain field, obviating the need to repair or replace the distribution tank.

Figure 3:
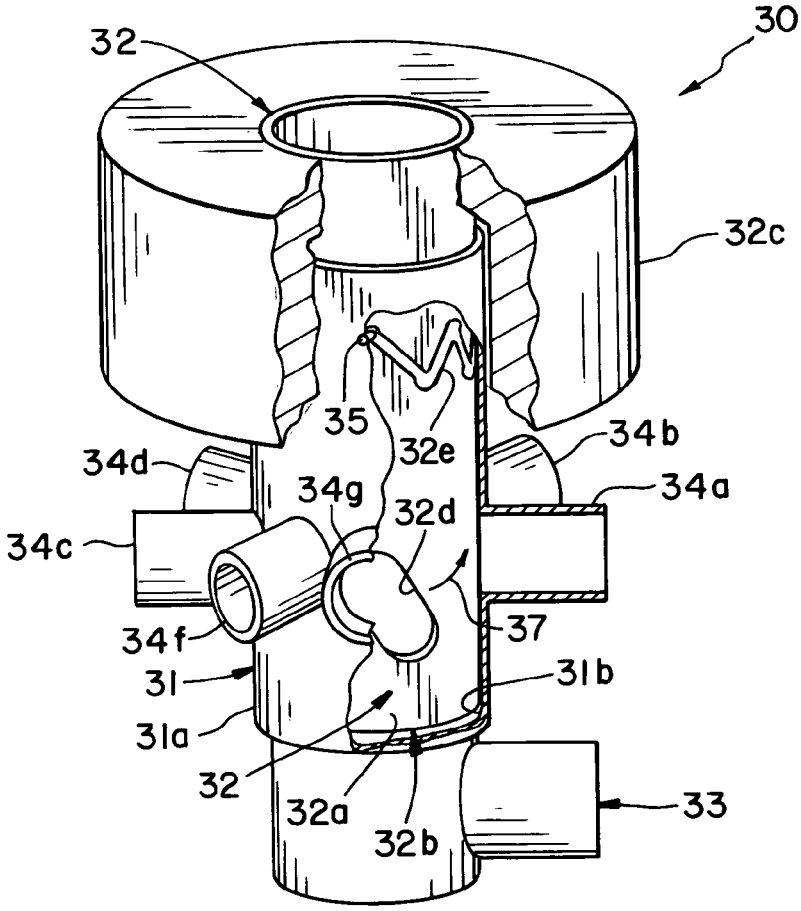
FIG. 3 is a cut-away perspective view of another preferred effluent-operated valve of the invention with a frontal portion of its outer outlet-forming element cut away to illustrate the inner operative elements of the valve.
Figure 4:
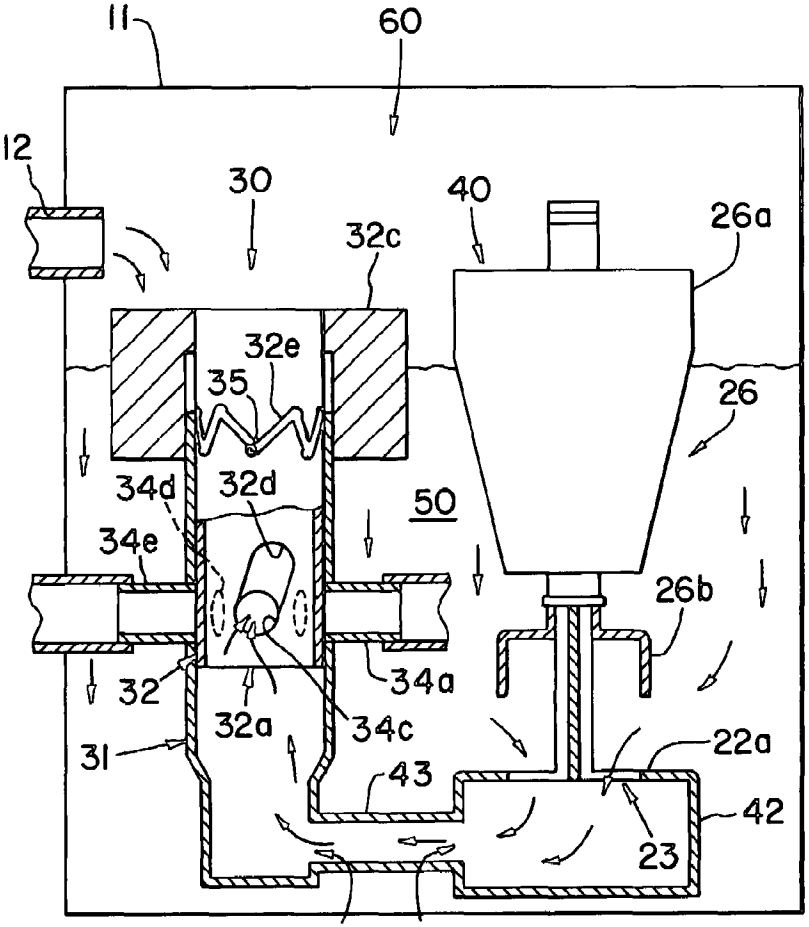
FIG. 4 is a diagrammatic illustration of the effluent-operated valves of FIGS. 2 and 3 combined and installed in a distribution tank, with both valves in their open positions.
Figure 5:
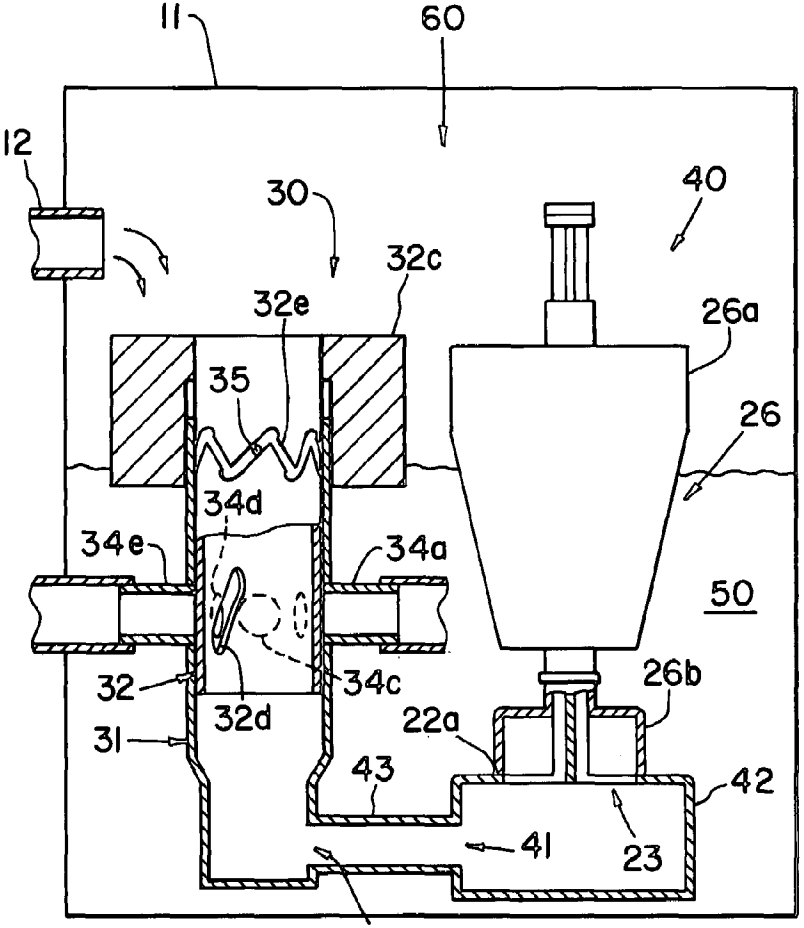
FIG. 5 is a diagrammatic illustration of the installation of effluent-operated valves that is illustrated in FIG. 4, with both valves in their closed positions and with the second-effluent-operated valve being indexed by accumulating effluent.

A second preferred effluent-operated valve of the invention is shown in FIGS. 3–5. FIG. 3 is a perspective view of the second preferred effluent-operated valve of the invention 30 with frontal portions of outer outlet-forming element 31 and buoyant material 32*c* partially cutaway to illustrate the inner valving element 32 and operative portions of the valve 30. The second preferred effluent-operated valve 30 is preferably used in combination with a first effluent-operated valve like that shown in FIGS. 2A–2C, to distribute sewage to the fingers of a septic system one at a time, in sequence. FIGS. 4 and 5 illustrate the second effluent-operated valve 30 in its preferred combination with a first effluent-operated valve 40 installed in a distribution tank 11. When installed in a distribution tank 11, an effluent-operated valve means 30 comprises means for distributing effluent uniformly to a plurality of fingers in a septic system by providing an effluent-operated valve means for connection of effluent within a distribution tank to a different one of a plurality of outlets each time effluent accumulates in the distribution tank. The valve means 30 has an inlet 33 adjacent its bottom and a plurality of outlets 34*a*, 34*b*, 34*c* . . . 34*x*, with each of the valve outlets 34*a*, 34*b*, 34*c* . . . 34*x* being connectible to different one of a plurality of fingers of a drain field, wherein an accumulation of effluent can operate the effluent-operated valve means 30, connecting the valve inlet 33 to one of the plurality of valve outlets 34*a*,34*b*,34*c* . . . 34*x* and permit effluent to flow from a distribution tank 11, through the one connected outlet to one of the fingers of a drain field. (One skilled in the art will recognized that the outer outlet-forming element 31 can be provided with any reasonable number of outlet openings, which in this description is indicated by the nomenclature "34*a*, 34*b*, 34*c* . . . 34*x*".) The valve means 30 can be operated by effluent in a distribution tank to sequentially connect the inlet 33 to one of the plurality of outlets 34*a*, 34*b*, 34*c* . . . 34*x*, one after the other, permitting effluent to flow to the plurality of fingers of a drain field, one finger at a time, in sequence. comprises an outer outlet-forming element 31 having an open inlet 33 and a cylindrical side wall 3 la with a plurality of spaced outlet openings 34*a*, 34*b*, 34*c* . . . 34*x*, as shown in FIG. 3. The cylindrical side wall 31*a* also carries a camming element 35, which protrudes from the inside cylindrical surface 31*b* of the outer outlet-forming element 31. As indicated in FIG. 3, the outer outlet-forming element 31 slidably and rotatably carries an inner valving element 32. The inner valving element 32 is formed by a cylindrical side wall 32*a*, which has an open bottom 32*b* and whose top is connected with a body of material 32*c* that is buoyant in the effluent. The cylindrical side wall 32*a* of the inner valving element 32 has a single opening 32*d*. The outside surface of the cylindrical side wall 32*a* has formed therein a saw tooth or zigzag camming surface 32*e*. In operation of effluent-operated valve 30, the sawtooth or zigzag camming surface 32*e* is engaged by the stationary protrusion of camming element 35, and the engagement of camming element 35 and camming surfaces 32*e* rotates the inner valving element 32 as it travels downwardly and upwardly in response to the depletion and accumulation of effluent, which generates a lifting force on the inner valving element 32 due to the buoyancy of the body of material 32*c*. As illustrated in FIGS. 3–5, the single opening 32*d* of the inner valving element 32 is elongated with a central axis that maintains the single opening 32*d* of the inner valving element 32 aligned with one of the outlet openings 34*a*, 34*b*, 34*c* . . . 34*x* during the downward travel of the inner valving element 32.

In operation of the second effluent-operated valve 30, the buoyant material 32*c* can react to accumulating effluent in a distribution tank 11 and raise the inner valving element 32 and, as a result of the engagement of the camming protrusion 35 and the saw tooth or zigzag camming surface 32*e*, rotate the inner valving element 32, thereby locating the single opening 32*d* of the inner valving element 32 in alignment with one of the plurality of spaced outlets 34*a*, 34*b*, 34*c* . . . 34*x* of the outer outlet-forming element 31, opening the one outlet opening aligned with the single opening 32*d*. Therefore, when the inlet 33 of the outer outlet-forming element 31 is exposed to an accumulation of effluent in a distribution tank 11, effluent can flow from the distribution tank 11 through the valve inlet 33 and open bottom 32*b* of the inner element 32 of the second effluent-operated valve 30 and the open one of the plurality of spaced outlets 34*a*, 34*b*, 34*c* . . . . 34*x* that is aligned with the single opening 32*d* of the inner valving element 32, to the portion of the drain field connected to the open one of the outlet openings 34*a*, 34*b*, 34*c* . . . 34*x* (shown in FIG. 4). As effluent flows from the distribution tank, the buoyant material 32*c* is no longer supported by the effluent within the distribution tank 11, and the inner valving element 32 falls, and is rotated, by the engagement of the cam protrusion 35 with the saw tooth or zigzag camming surface 32*e*. Because the single opening 32*d* is elongated with a central axis that maintains the single opening aligned with the open one of the outlet openings 34*a*, 34*b*, 34*c* . . . 34*x*, the effluent in the distribution tank 11 continues to flow from the distribution tank 11 to the connected portion of the drain field as the inner valving element 32 falls until the distribution tank is substantially empty. The saw tooth or zigzag camming surface 32*e* is designed so that as accumulating effluent in a distribution tank 11 thereafter raises the inner valving element 32, the engagement of the saw tooth or zigzag camming surface 32*e* and the camming element 35 rotates the inner valving element 32, removing the single outlet opening 32*d* from alignment with the formerly opened one of the plurality of outlet openings 34*a*, 34*b*, 34*c* . . . 34*x*, and positioning the single outlet opening 32*d* of the inner valving element 32 in alignment with the outlet opening (one of 34*a*, 34*b*, 34*c* . . . or 34*x*) next adjacent the outlet opening that was opened on the former cycle. Each filling and emptying of the distribution tank 11 constitutes a cycle of operation of the second effluent-operated valve 30 by which the plurality of outlet openings 34*a*, 34*b*, 34*c* . . . 34*x* are opened in sequence, one after the other, allowing effluent to flow from a distribution tank 11 to only one of the fingers of a drain field, but distributes the effluent to all the fingers of the drain field, one at a time, in sequence.

Thus, a second effluent-operated valve means 30 comprises an outer distributor element 31 and inner valving element 32 that is rotatably and slidably carried within the outer distributor element 31. The outer distributor element 31 includes a camming element 35, an effluent inlet 33 adjacent its bottom and a plurality of outlets 34*a*, 34*b*, 34*c* . . . 34*x*, which are connectible with the fingers of a septic system drain field. The inner element 32 has an open bottom 32*b* which forms a chamber with a single outlet 32*d* in its side. The upper portion of the inner element 32 is connected with a body of buoyant material 32*c*, and a camming groove 32*e* is formed in its outer surface 32*a*. When no accumulation of effluent is present adjacent the second effluent-operated valve means 30, after, for example, a distribution tank has been emptied, the inner element 32 is adjacent the bottom of the distributor element 31, as shown in FIG. 3 which illustrates the single opening 32*d* in alignment with outlet opening 34*g*. With respect to the illustration of FIG. 3, the single opening 32*d* of the inner valving element 32 was aligned with the outlet opening 34*g* during an earlier accumulation of effluent adjacent the valve 30 and the earlier accumulation of effluent adjacent the valve 30 has been depleted by its flow through the inlet 33, the open bottom 32*b* of the inner valving element 32 and the aligned single opening 32*d* of the inner valving element 32 and outlet opening 34*g* of the outer outlet-forming element 31. As illustrated in FIG. 3, the sidewall 32*a* of the inner element 32 blocks all of the outlet openings of the distributor element 31 except the open outlet 34*g* so no effluent can flow into any of the fingers of the drain field except the finger connected with open outlet opening 34*g*. As effluent accumulates adjacent the second effluent-operated valve 30, the accumulated effluent lifts the inner element 32 because of the buoyant material 32*c*. As the inner element 32 rises, it is rotated as a result of the engagement of camming element 35 with the camming groove 32*e* formed on the outside of the inner element 32. The rising and rotation of the inner outlet 32, indicated by the arrow 37 in FIG. 3, aligns the single outlet opening 32*d* of the inner element 32 with different ones of the outlets 34*a*, 34*b*, 34*c* . . . 34*x* of the distributor element 31, distributing effluent into different ones of the fingers of the drain field, one after the other in sequence. For example, in the FIG. 3 illustration, as the inner element 32 rises as a result of accumulating effluent, it is rotated by engagement of the cam element 35 with the camming groove 32*e* and the single opening 32*d* of the inner element 32 will travel in the direction of arrow 37 into alignment with the outlet opening 34*a* of the outer element 31, which will result in the distribution of effluent through inlet opening 33, the open bottom 32*b* and single opening 32*d* of the inner element 32 and through outlet opening 34*a* to the connected finger of the sewage drain field.

Although operation of the second preferred effluent-operated valve 30 is described as being effected by the engagement of a camming grove 32*e* formed in the outer surface 32*a* of the inner valve element 32 and a stationary cam element 35 which protrudes into and interacts with the camming groove 32*e*, those skilled in the art will recognize that other camming surfaces, combinations and means may be used to sequence the alignment of the single opening 32*d* of the inner element 32 with a single one of the plurality of outer openings 34*a* . . . 34*x* of the outer element 31. Such sequencing and camming means are shown, for example, in U.S. Pat. Nos. 6,622,933; 6,345,645; 6,050,286; 5,022,426; 4,790,512; 4,632,361; 4,492,247; 4,313,455; 4,116,216; 4,092,995; and 2,793,908.

One preferred effluent-operated valve 30 can include an outer outlet-forming cylinder 31 having an outer diameter of from about three to about eight inches and a wall thickness of about ⅛-inch to ¼-inch formed from a standard thermoplastic material, such as nylon or polyvinylchloride tubing, or can be molded from polyethylene, polypropylene, polyvinylchloride, nylon or the like. The inner cylindrical valving element 32 can also comprise a thermoplastic material, such as nylon or polyvinylchloride tubing, whose outside dimension is sized to fit closely within the outer outlet-forming cylinder 31, allowing sufficient clearance so that the inner valving element 32 can slide and rotate freely within the cylindrical outlet-forming member 31 and so that the clearance between the outside surface 32*a* of the inner valving element 32 and the inside surface 31*b* of the cylindrical member 31 does not permit a significant flow of effluent through the interface of the two members 31 and 32. The single opening 32*d* of the inner member 32 is preferably elongated, with a length of its major axis being about twice the diameter of the outlet openings 34*a*, 34*b*, 34*c* . . . 34*x*, for example with a length of about one and one-half to about two inches and a width of about an inch, and the long axis of the single opening 32*d* lies at an angle approximately the angle of the sawtooth or zigzag camming groove portion that is engaged with the camming element 35 as the inner valving element 32 is falling. The sawtooth groove 32*d* preferably provides a maximum vertical travel that is chosen to correspond with the diameters of the outlet openings 34*a*, 34*b*, 34*c* . . . 34*x*, for example, of about one and one-half to about two inches when the outlet openings 34*a*, 34*b*, 34*c* . . . 34*x* are about one inch in diameter, and its angled travel is chosen to correspond with the number of outlet openings 34*a*, 34*b*, 34*c* . . . 34*x* in the cylindrical outlet-forming outer member 31.

A preferred distribution means 60 of the invention is illustrated in FIGS. 4 and 5, and includes a first effluent-operated valve 40 and a second effluent-operated valve 30 combined for installation in a distribution tank 11.

In the preferred means 60 of the invention, the first effluent-operated valve 40 is identical to the effluent-operated valve 20 illustrated in FIG. 2A and described above, with the exception of the distributor element 42, which can be in all respects identical to the distributor element 22 illustrated in FIG. 2A, except for having a single outlet 41, as illustrated in FIGS. 4 and 5, rather than a plurality of outlets as in the valve illustrated in FIG. 2A.

As illustrated in FIGS. 4 and 5, the first effluent-operated valve 40 and the second effluent-operated valve 30 may be installed in a distribution tank adjacent its bottom, and the outlet 41 of the first effluent-operated valve 40 is connected to the inlet 33 of the second effluent-operated valve 30, which is identical to the effluent-operated valve 30 illustrated in FIG. 3. In both FIG. 4 and FIG. 5, selected portions of the first and second effluent-operated valves 40, 30 have been cutaway to illustrate the operation of the valves. In FIGS. 4 and 5, the lower valve-forming portions of the first effluent-operated valve 40 have been cutaway and the lower portions of valve 40 appear in cross-section taken at a plane through the central axis of the valve 40 in its open (FIG. 4) and closed (FIG. 5) positions. In FIGS. 4 and 5, the second effluent-operated valve 30 is illustrated with its outer outlet-forming element 31 shown in cross-section taken at a plane through its central axis (with the exception of an indication of the position of the camming protrusion 35 of the outer outlet-forming element 31 with respect to the sawtooth or zigzag camming surface 32*e*), and with its inner valving element 32 partially cutaway in its lower portion and shown in cross-section to illustrate positions of its single elongated opening 32*d* with respect to the outlet openings 34*a*, 34*b*, 34*c* . . . 34*x* of the outer outlet forming element 31 during operation of the second effluent-operated valve. The buoyant material 32*c* and the piping are illustrated in cross-sections taken at planes through their central axes in both FIGS. 4 and 5.

FIG. 4 illustrates the system with the distribution tank 11 full of accumulated effluent 50. In this preferred system, the flow of effluent into the distribution tank 11 from the septic tank 10 has accumulated and acted on and lifted the buoyant material 26*a* of the effluent-driven valve member 26 of the first effluent-operated valve 40 and the buoyant material 32*c* connected with the inner element 32 of the second effluent-operated valve 30. The accumulated effluent in the distribution tank 11, by lifting the buoyant material 26*a* of the first effluent-operated valve 40 and the buoyant material 32*c* of the second effluent-operated valve 30, has operated the first and second effluent-operated valves 40, 30, opening the inlet 23 of the first effluent-operated valve 40 and aligning the single opening 32*d* of the inner valving element 32 of the second effluent-operated valve 30 with one of the outlets 34*a*, 34*b*, 34*c* . . . 34*x* of the second effluent-operated valve, specifically outlet opening 34*c* as shown in FIG. 4. The operation of the first and second effluent-operated valves 40, 30, as illustrated by FIG. 4, allows a flow of effluent from the distribution tank 11 through inlet opening 23 and distribution element 42 of the first effluent-operated valve 40, and through the pipe 43 that interconnects the outlet 41 of the first effluent-operated valve 40 with the inlet 33 of the second effluent-operated valve 30, and through the open bottom 32*a*and single opening 32*d* of the inner element 32 of the second effluent-operated valve 30 and through the aligned and open outlet 34*c* of the second effluent-operated valve 30 for delivery to the portion of the drain field that is connected to the opened outlet 34*c*. As the level of effluent in distribution tank 11 falls, the outlet opening 34*c* will remain open as a result of the angled and elongated single opening 32*d* and the rotation imposed on the inner valving element 32 by the interaction of the sawtooth or zigzag camming surface 32*e* and the camming element 35. When the effluent in the distribution tank 11 will no longer support the buoyant material 26*a* of the effluent-driven valve member 26 of the first effluent-operated valve 40 and the buoyant material 32*c* of the second effluent-operated valve 30, effluent-driven valve member 26 closes inlet 23 of the first effluent-operated valve 40, blocking any further drainage of effluent from the distribution tank 11 to the drain field.

As effluent again accumulates in the distribution tank 11 and lifts the buoyant material 32*c* of the second effluent-operated valve 30, the inner element 32 is lifted and rotated, moving until its single opening 32*d* toward alignment with outlet opening 34*d* of the second effluent-driven valve 30, as illustrated in FIG. 5. The accumulation of effluent in the distribution tank 11 will eventually align the single opening 32*d* of the inner valving element 32 with outlet opening 34*d* and open inlet 23 of the first effluent operated valve 40, permitting effluent to flow from the distribution tank 11 through the first and second effluent-operated valves 40, 30 and outlet opening 34*d* to the portion of the drain field connected to outlet opening 34*d* in the manner illustrated in FIG. 4. The cycle is continued each time the distribution tank 11 is emptied and filled by the actions of the first and second effluent-operated valves 40, 30, and the effluent from the distribution tank 11 flows to another and different one of the fingers of the drain field, thus giving the effluent in each of the finger systems an opportunity to drain from the finger system prior to its next exposure to a flow of effluent and giving each finger of the drain field an opportunity to "perc" between exposures to effluent.

The above description is directed to certain preferred embodiments of the invention, and those skilled in the art will recognize that other embodiments may be devised using the invention. It is, therefore, intended that the foregoing description be regarded as illustrative rather than limiting, and that it be understood that it is the following claims, including all equivalents, that are intended to define the spirit and scope of this invention.

What is claimed:

1. Means for distributing sewage effluent to a plurality of fingers of a drain field in a septic system, comprising a tank for the collection of effluent to be distributed to a plurality of fingers, and effluent-operated valve means within said tank for connection of effluent within said tank to at least one of the plurality of fingers, said effluent-operated valve means having a valve inlet that opens into said tank and a plurality of valve outlets, each of said plurality of valve outlets being connected with one of the plurality of fingers, wherein accumulated effluent in said tank operates said effluent-operated valve means to sequentially connect the valve inlet to at least one of the plurality of valve outlets, one after another, permitting effluent to flow from said tank sequentially to at least one of the plurality of said fingers, one finger at a time.

2. The means of claim 1 wherein said effluent-operated valve means comprises an outer outlet-forming cylinder having said valve inlet adjacent its bottom and said plurality of valve outlets formed in and about its side, an inner valving cylinder slidably and rotatably carried within said outer outlet-forming cylinder, said inner valving cylinder having an open bottom and a single opening formed in its side and having its upper end connected with a body of buoyant material, said outer outlet-forming cylinder and said inner valving cylinder forming a camming means for said inner valving cylinder whereby each accumulation of effluent in said tank operates said buoyant material connected with said inner valving cylinder, lifting said inner valving cylinder and rotating said inner valving cylinder through the action of said camming means to align said single opening of said inner valving cylinder with a different one of the plurality of outlets formed in said outer outlet-forming cylinder, thereby distributing effluent to the plurality of fingers one at a time in sequence.

3. The means of claim 2 wherein said camming means comprises a sawtooth groove formed in the outer surface of said inner valving cylinder and a camming element extending from the inner surface of the outer outlet-forming cylinder into the sawtooth groove, whereby up and down motion of the inner valving cylinder due to the accumulation in and depletion of effluent in said tank rotates said inner valving cylinder and locates said single opening of said inner valving cylinder in alignment with different ones of the plurality of outlets formed in the outer cylinder and permits effluent to be directed to said different ones of the plurality of outlets.

4. Means for distributing sewage effluent to a plurality of fingers of a drain field in a septic system, comprising a tank for the collection of effluent to be distributed to a plurality of fingers, and effluent-operated valve means within said tank for connection of the effluent within said tank to at least one of the plurality of fingers, said effluent-operated valve means having a valve inlet that opens into said tank and a distributor element with a closed bottom and with said valve inlet formed in its upper end by a flange and with a plurality of valve outlets formed in and about its closed bottom, and a valve closure connected with a buoyant element actuated by the accumulated effluent in said tank, said valve closure having a sealing portion at its bottom to engage said flange and seal the valve inlet when said buoyant member is not actuated by accumulated effluent in the tank, each of said plurality of valve outlets being connected with one of the plurality of fingers, wherein accumulated effluent in said tank operates said effluent-overated valve means connecting valve inlet to at least one of the plurality of valve outlets, permitting effluent to flow from said tank to at least one of said fingers.

5. The means of claim 4 wherein said effluent-operated valve means is operated by accumulated effluent in said tank to connect said valve inlet to the plurality of valve outlets, permitting effluent to flow to all of the plurality of fingers.

6. The means of claim 4 wherein said valve closure comprises a concave elastomeric member with said buoyant element above and connected to said concave elastomeric member, and wherein the distributor clement carries a guide rod extending upwardly from the center of the upper portion of the distributor element, said concave elastomeric member and buoyant member having an open central bore for slidable engagement with the guide rod.

7. In a septic system including a distribution tank for distribution of effluent to a plurality of fingers in a drain field, the improvement comprising an effluent-operated valve in said distribution tank for controlling the distribution of effluent from the distribution tank, including a distributing valve element having a closed bottom, a side wall with a plurality of spaced openings, and an inlet-forming open top with a valve-forming flange surface; and a valve closure element having a peripheral seal-forming surface adapted to engage the valve-forming flange surface of the distributing valve element and to close its inlet-forming open top, a buoyant member connected with the valve closure element, and means carried by the distributing valve element and forming a guide rod in sliding engagement with the valve closure element, wherein said buoyant member can move in reaction to effluent in the distribution tank to raise the valve closure element and open the inlet-forming top of the distributing valve element, allowing effluent to enter the inlet-forming open top and flow simultaneously from the plurality of spaced openings in the distributing valve element and to lower the valve closure element, as effluent flows from the distribution tank, into sealing engagement with the valve-forming flange surface of the distributing valve element, said valve closure element being guided in said movement by said guide rod.

8. The improvement of claim 7 wherein said valve closure element is a concave elastomeric element forming with its lower edge said peripheral seal-forming surface.

9. The improvement of claim 7 wherein said distributing valve element has a cylindrical side wall and said valve-forming flange surface is annular and surrounds the inlet-forming open top of the distributing valve element.

10. The improvement of claim 7 wherein said float is formed from polyethylene foam in the shape of an inverted cone.

11. In a septic system including a distribution tank for distributing effluent to a plurality of fingers, the improvement comprising an effluent-operated valve in said distribution tank for controlling the distribution of effluent from said tank, comprising an outer outlet-forming element having an open inlet adjacent its bottom and a cylindrical sidewall with a plurality of spaced outlet openings; an inner valving element slidably and rotatably carried within said outer outlet-forming element, said inner valving element having an open bottom, a cylindrical side wall with a single opening, and a body of buoyant material connected with said inner valving element, the outside surface of the cylindrical side wall of the inner valving element having formed therein a sawtooth camming surface and the inside surface of the outer outlet-forming element carrying a camming protrusion engaged with the sawtooth camming surface of the inner valving element, wherein said buoyant material connected with said inner valving element can react to effluent in the distribution tank to raise the inner valving element and as a result of the engagement of the camming protrusion and sawtooth camming surface, rotate the inner valving element thereby locating the single opening of the inner valving element in alignment with one of the plurality of spaced outlet openings of the outer outlet-forming element to allow effluent to flow from the distribution tank through the open inlet of the outer outlet-forming element and the open bottom of the inner valving element and through said one of the plurality of spaced outlets, and wherein the flow of effluent from the distribution tank lowers the inner valving element while allowing effluent to flow from the distribution tank and positioning the sawtooth camming surface of the inner valving element with respect to the camming protrusion of the outer outlet-forming element so that subsequent upward motion of the inner-valving element in response effluent in the distribution tank will advance the single opening of the inner valve element into alignment with another one of the plurality of spaced outlet openings.

12. The improvement of claim 11 wherein said spaced outlet openings of said outer outlet-forming element are round and said single opening of said inner-valving element is elongated, with its major axis lying generally in the same direction as the surface of the sawtooth camming surface that is active as the inner valving element is falling.

13. A system for disiributing the effluent of a septic system to a plurality of fingers in a drain field, comprising a distribution tank for receiving effluent to be distributed to the plurality of fingers, a first effluent-operated valve in said distribution tank; said first effluent-operated valve having a valve body with an inlet opening and an outlet opening, and a valve element connected with a buoyant element and operated by accumulated effluent in said distribution tank to allow effluent to flow through said inlet and outlet openings of said valve body, and upon the depletion of the effluent in said distribution tank to stop the flow of effluent through the inlet and outlet openings, and a second effluent-operated valve in said distribution tank having an inlet opening and a plurality of outlet openings, said inlet opening of the second effluent-operated valve being connected with the outlet opening of the first effluent-operated valve, each of the plurality of outlet openings being connectible with a different one of the plurality of fingers, said second effluent-operated valve having a valving member with a single opening driven by connected buoyant material, said valving member being operated by effluent in said distribution tank to lift and rotate the valving member and align its single opening with different ones of the plurality of outlet openings, thereby allowing effluent to flow from the distribution tank to a finger that may be connected to said different ones of the plurality of outlet openings.

14. The system of claim 13 wherein said first effluent-operated valve comprises a cylindrical distributor element with a closed bottom and with said inlet opening being formed in its upper end by an annular flange and with the outlet opening being formed adjacent to or in the closed bottom, and said valve closure has an annular sealing portion at its bottom to engage said annular flange and seal the valve inlet when said buoyant member is not activated by accumulated effluent in said tank.

15. The system of claim 14 wherein said valve closure comprises a concave elastomeric member with said buoyant element above and connected to said concave elastomeric member, and wherein the cylindrical distributor element includes a guide rod extending upwardly from the center of the upper portion of the cylindrical distributor element, said concave elastomeric member and buoyant member having an open central bore for slidable engagement with the guide rod.

16. The system of claim 13 wherein said second effluent-operated valve means comprises an outer outlet-fanning cylinder having said valve inlet at its bottom and said plurality of valve outlets formed in and about its lower end, and said valving member comprises an inner valving cylinder slidably and rotatably carried within said outer outlet-forming cylinder, said inner valving cylinder having an open bottom and said single opening formed in its cylindrical side and having its upper end connected with a body of buoyant material, said outer outlet-forming cylinder and said inner valving cylinder combining to form a camming means for said inner valving cylinder whereby each accumulation of effluent in said distribution tank operates said buoyant material connected with said inner valving cylinder, lifting said inner valving cylinder and rotating said inner valving cylinder through the action of said camming means to align said single opening of said inner valving cylinder with a different one of the plurality of outlets fanned in said outer outlet-forming cylinder, permitting effluent to flow to said different one of the plurality of fingers and thereby distributing effluent to the plurality of fingers one at a time in sequence.

17. The system of claim 16 wherein said camming means comprises a sawtooth groove formed in the outer surface of said inner valving cylinder and a camming element extending from the inner surface of the outer outlet-forming cylinder into the sawtooth groove, whereby up and down motion of the inner valving cylinder due to the accumulation and depletion of effluent in said distribution tank rotates said inner valving cylinder and locates said single opening of said inner valving cylinder in alignment with said different ones of the plurality of outlets fanned in the outer cylinder.

18. The system of claim 13 wherein said second effluent-operated valve comprises an outer outlet-forming cylindrical member that slidably and rotatably carries said valving member, said outer outlet-forming member and valving member combining to provide a cammed rotation of said valving member as said valving member travels up and down in said outer outlet-forming member in response to the accumulation and depletion of effluent in the distribution tank.

19. Valve means for distributing sewage effluent to a plurality of fingers of a drain field in a septic system, comprising an effluent-operated valve means for distribution of the effluent to at least one of the plurality of fingers, said effluent-operated valve means having a valve inlet for admission of said effluent and a distributor element with a closed bottom and with said valve inlet formed in its upper end by a flange and with a plurality of valve outlets formed in and about its closed bottom, and further having a valve closure connected with a buoyant element for actuation by accumulated effluent said valve closure having a sealing portion at its bottom to engage said flange and seal the valve inlet when said buoyant member is not actuated by accumulated effluent, each of said plurality of valve outlets being connected with one of the plurality of fingers, wherein accumulated effluent operates said effluent-operated valve means connecting the valve inlet to at least one of the plurality of valve outlets, permitting effluent to flow to said at least one of said fingers.

20. The valve means of claim 19 wherein said effluent-operated valve means is operated by accumulated effluent to connect said valve inlet to the plurality of valve outlets, permitting effluent to flow to all of the plurality of fingers.

21. The valve means of claim 19 wherein said valve closure comprises a concave elastomeric member with said buoyant element above and connected to said concave elastomeric member, and wherein the distributor element carries a guide rod extending upwardly from the center of the upper portion of the distributor element, said concave elastomeric member and buoyant member having an open central bore for slidable engagement with the guide rod.

22. Valve means for distributing sewage effluent to a plurality of fingers of a drain field in a septic system, comprising an effluent-operated valve means for distribution of the effluent to at least one of the plurality of fingers, said effluent-operated valve means having a valve inlet for admission of said effluent and a plurality of valve outlets, each of said plurality of valve outlets being connected with one of the plurality of fingers, the said effluent-operated valve means being operated by accumulated effluent to sequentially connect the valve inlet to one of the plurality of valve outlets, one after another, permitting effluent to flow sequentially to the plurality of fingers, one finger at a time.

23. The valve means of claim 22 wherein said effluent-operated valve means comprises an outer outlet-forming cylinder having said valve inlet adjacent its bottom and said plurality of valve outlets formed in and about its side, an inner valving cylinder slidably and rotatably carried within said outer outlet-forming cylinder, said inner valving cylinder having an open bottom and a single opening formed in its side and having its upper end connected with a body of buoyant material, said outer outlet-forming cylinder and said inner valving cylinder forming a camming means for said inner valving cylinder whereby repeated accumulation and depletion of effluent operates said buoyant material connected with said inner valving cylinder, lifting and lowering said inner valving cylinder and rotating said inner valving cylinder through the action of said camming means to align said single opening of said inner valving cylinder with a different one of the plurality of outlets formed in said outer outlet-forming cylinder and distribute effluent to the plurality of fingers one at a time in sequence.

24. The valve means of claim 23 wherein said camming means comprises a sawtooth groove formed in the outer surface of said inner valving cylinder and a camming element extending from the inner surface of the outer outlet-forming cylinder into the sawtooth groove, whereby up and down motion of the inner valving cylinder due to the accumulation in and depletion of effluent adjacent said valve means rotates said inner valving cylinder and locates said single opening of said inner valving cylinder in alignment with different ones of the plurality of outlets formed in the outer cylinder and distributes effluent through said different ones of the plurality of outlets formed in the outer cylinder.

25. Valve means for distributing the effluent of a septic system to a plurality of fingers in a drain field, comprising a first effluent-operated valve having a valve body with an inlet opening and an outlet opening, and a valve element connected with a buoyant element and operated by accumulated effluent to allow effluent to flow through said inlet and outlet openings of said valve body, and upon the depletion of effluent to stop the flow of effluent through the inlet and outlet openings, and a second effluent-operated valve having an inlet opening and a plurality of outlet openings, said inlet opening of the second effluent-operated valve being connected with the outlet opening of the first effluent-operated valve, each of the plurality of outlet openings being connectible with a different one of the plurality of fingers, said second effluent-operated valve having a valving member with a single opening driven by connected buoyant material, said valving member being operated by effluent to lift and rotate the valving member and align its single opening with different ones of the plurality of outlet openings, thereby allowing effluent to flow to a portion of a drain field that may be connected to said different ones of the plurality of outlet openings.

26. The valve means of claim 25 wherein said first effluent-operated valve comprises a distributor element with a closed bottom and with said inlet opening being formed in its upper end by a flange and with outlet opening being formed adjacent to or in the closed bottom, and said valve closure has a sealing portion at its bottom to engage said flange and seal the valve inlet when said buoyant member is not activated by accumulated effluent.

27. The valve means of claim 26 wherein said valve closure comprises a concave elastomeric member with said buoyant element above and connected to said concave elastomeric member, and wherein the distributor element is cylindrical and includes a guide rod extending upwardly from the center of the upper portion of the cylindrical distributor element, said concave elastomeric member and buoyant member having an open central bore for slidable engagement with the guide rod.

28. The valve means of claim 25 wherein said second effluent-operated valve means comprises an outer outlet-forming cylinder having said valve inlet at its bottom and said plurality of valve outlets formed in and about its lower end, and said valving member comprises an inner valving cylinder slidably and rotatably carried within said outer outlet-forming cylinder, said inner valving cylinder having an open bottom and said single opening fanned in its cylindrical side and having its upper end connected with a body of buoyant material, said outer outlet-forming cylinder and said inner valving cylinder combining to form a camming means for said inner valving cylinder whereby each repeated accumulation and depletion of effluent operates said buoyant material connected with said inner valving cylinder, lifting and lowering said inner valving cylinder and rotating said inner valving cylinder through the action of said camming means to align said single opening of said inner valving cylinder with a different one of the plurality of outlets formed in said outer outlet-forming cylinder, permitting effluent to flow through different ones of the plurality of fingers and thereby distributing effluent to the plurality of portions of a drain field one at a time in sequence.

29. The system of claim 28 wherein said camming means comprises a sawtooth groove formed in the outer surface of said inner valving cylinder and a camming element extending from the inner surface of the outer outlet-forming cylinder into the sawtooth groove, whereby up and down motion of the inner valving cylinder due to the accumulation is and depletion of effluent lifts and rotates said inner valving cylinder and locates said single opening of said inner valving cylinder in alignment with different ones of the plurality of outfits formed in the outer cylinder.

30. The system of claim 25 wherein said second effluent-operated valve comprises an outer outlet-forming cylindrical member that slidably and rotatably carries said valving member, said outer outlet-forming member and valving member combining to provide a cammed rotation of said valving member as said valving member travels up and down in said outer outlet-forming member in response to the accumulation and depletion of effluent.

* * * * *

UNITED STATES PATENT AND TRADEMARK OFFICE

CERTIFICATE OF CORRECTION

PATENT NO. : 7,040,840 B2
APPLICATION NO. : 10/988879
DATED : May 9, 2006
INVENTOR(S) : Neal Zook It is certified that error appears in the above-identified patent and that said Letters Patent is hereby corrected as shown below:

Column 10

Line 32, insert -- the -- between "of" and "effluent".

Column 11

Line 1, delete "the" between "to" and "accumulation".
Line 2, delete "in" before the word "and".

Column 14

Line 50, delete "the" between "fingers," and "said".

Column 15

Line 13, delete "in" between "accumulation" and "and".

Column 16

Line 17, delete "fanned" and insert -- formed --.
Line 38, delete "is" between "accumulation" and "and".
Line 41, delete "outfits" and insert -- outlets --.

Signed and Sealed this

First Day of August, 2006

JON W. DUDAS
*Director of the United States Patent and Trademark Office*